US010982392B2

(12) United States Patent
Sealey et al.

(10) Patent No.: US 10,982,392 B2
(45) Date of Patent: Apr. 20, 2021

(54) ABSORBENT STRUCTURES WITH HIGH WET STRENGTH, ABSORBENCY, AND SOFTNESS

(71) Applicant: STRUCTURED I, LLC, Great Neck, NY (US)

(72) Inventors: James E. Sealey, Belton, SC (US); Byrd Tyler Miller, IV, Easley, SC (US); Kevin Brennan, Anderson, SC (US); James E. Bradbury, Anderson, SC (US); Phillip MacDonald, Anderson, SC (US); Taras Z. Andrukh, Greenville, SC (US)

(73) Assignee: STRUCTURED I, LLC, Great Neck, NY (US)

( * ) Notice: Subject to any disclaimer, the term of this patent is extended or adjusted under 35 U.S.C. 154(b) by 0 days.

(21) Appl. No.: 16/533,946

(22) Filed: Aug. 7, 2019

(65) Prior Publication Data

US 2019/0368129 A1 Dec. 5, 2019

Related U.S. Application Data

(62) Division of application No. 15/687,116, filed on Aug. 25, 2017, now Pat. No. 10,422,082.

(60) Provisional application No. 62/380,137, filed on Aug. 26, 2016.

(51) Int. Cl.

| | |
|---|---|
| ***D21H 21/20*** | (2006.01) |
| ***D21H 17/00*** | (2006.01) |
| ***D21H 17/37*** | (2006.01) |
| ***D21H 27/00*** | (2006.01) |
| ***D21C 5/00*** | (2006.01) |
| ***D21H 17/42*** | (2006.01) |
| ***D21H 17/55*** | (2006.01) |
| ***D21H 27/30*** | (2006.01) |

(52) U.S. Cl.

CPC ..... *D21H 21/20* (2013.01); *D21C 5/005* (2013.01); *D21H 17/005* (2013.01); *D21H 17/375* (2013.01); *D21H 17/42* (2013.01); *D21H 17/55* (2013.01); *D21H 27/002* (2013.01); *D21H 27/005* (2013.01); *D21H 27/30* (2013.01)

(58) Field of Classification Search

USPC ..... 162/132

See application file for complete search history.

(56) References Cited

U.S. PATENT DOCUMENTS

| | | | |
|---|---|---|---|
| 2,919,467 | A | 1/1960 | Mercer |
| 2,926,154 | A | 2/1960 | Keim |
| 3,026,231 | A | 3/1962 | Chavannes |
| 3,049,469 | A | 8/1962 | Davison |
| 3,058,873 | A | 10/1962 | Keim et al. |
| 3,066,066 | A | 11/1962 | Keim et al. |
| 3,097,994 | A | 7/1963 | Dickens et al. |
| 3,125,552 | A | 3/1964 | Loshaek et al. |
| 3,143,150 | A | 8/1964 | Buchanan |
| 3,186,900 | A | 6/1965 | De Young |
| 3,197,427 | A | 7/1965 | Schmatz |
| 3,224,986 | A | 12/1965 | Butler et al. |
| 3,224,990 | A | 12/1965 | Babcock |
| 3,227,615 | A | 1/1966 | Korden |
| 3,227,671 | A | 1/1966 | Keim |
| 3,239,491 | A | 3/1966 | Tsou et al. |
| 3,240,664 | A | 3/1966 | Earle, Jr. |
| 3,240,761 | A | 3/1966 | Keim et al. |
| 3,248,280 | A | 4/1966 | Hyland, Jr. |
| 3,250,664 | A | 5/1966 | Conte et al. |
| 3,252,181 | A | 5/1966 | Hureau |
| 3,301,746 | A | 1/1967 | Sanford et al. |
| 3,311,594 | A | 3/1967 | Earle, Jr. |
| 3,329,657 | A | 7/1967 | Strazdins et al. |
| 3,332,834 | A | 7/1967 | Reynolds, Jr. |
| 3,332,901 | A | 7/1967 | Keim |
| 3,352,833 | A | 11/1967 | Earle, Jr. |
| 3,384,692 | A | 5/1968 | Galt et al. |
| 3,414,459 | A | 12/1968 | Wells |
| 3,442,754 | A | 5/1969 | Espy |
| 3,459,697 | A | 8/1969 | Goldberg et al. |
| 3,473,576 | A | 10/1969 | Amneus |
| 3,483,077 | A | 12/1969 | Aldrich |
| 3,545,165 | A | 12/1970 | Greenwell |
| 3,556,932 | A | 1/1971 | Coscia, et al. |
| 3,573,164 | A | 3/1971 | Friedberg et al. |
| 3,609,126 | A | 9/1971 | Asao et al. |
| 3,666,609 | A | 5/1972 | Kalwaites et al. |
| 3,672,949 | A | 6/1972 | Brown |
| 3,672,950 | A | 6/1972 | Murphy et al. |

(Continued)

FOREIGN PATENT DOCUMENTS

| | | | |
|---|---|---|---|
| CA | 2168894 | A1 | 8/1997 |
| CA | 2795139 | A1 | 10/2011 |

(Continued)

OTHER PUBLICATIONS

International Search Report PCT/US17148718 dated Nov. 8, 2017.
Written Opinion of PCT/US17/48718 dated Nov. 8, 2017.
Venditti, Richard, Dr., "Enzyme Applications in Pulp and Paper: An Introduction to Applications," Buckman Laboratories, (Slides courtesy of Phil Hoekstra). Apr. 29, 2009.
International Search Report for PCT/US16/56871 dated Jan. 12, 2017.

(Continued)

*Primary Examiner* — Mark Halpern
(74) *Attorney, Agent, or Firm* — Amster, Rothstein & Ebenstein LLP

(57) ABSTRACT

An absorbent structure with high wet strength, absorbency and softness made by a process including forming a stock mixture of fibers, a cationic wet strength resin, an anionic polyacrylamide and a cellulase enzyme, and at least partially drying the stock mixture to form a web.

5 Claims, 5 Drawing Sheets

(56) References Cited

U.S. PATENT DOCUMENTS 3,773,290 A 11/1973 Mowery
3,778,339 A 12/1973 Williams et al.
3,813,362 A 5/1974 Coscia et al.
3,855,158 A 12/1974 Petrovich et al.
3,877,510 A 4/1975 Tegtmeier et al.
3,905,863 A 9/1975 Ayers
3,911,173 A 10/1975 Sprague, Jr.
3,974,025 A 8/1976 Ayers
3,994,771 A 11/1976 Morgan, Jr. et al.
3,998,690 A 12/1976 Lyness et al.
4,038,008 A 7/1977 Larsen
4,075,382 A 2/1978 Chapman et al.
4,088,528 A 5/1978 Berger et al.
4,098,632 A 7/1978 Sprague, Jr.
4,102,737 A 7/1978 Morton
4,129,528 A 12/1978 Petrovich et al.
4,147,586 A 4/1979 Petrovich et al.
4,184,519 A 1/1980 McDonald et al.
4,190,692 A 2/1980 Larsen
4,191,609 A 3/1980 Trokhan
4,252,761 A 2/1981 Schoggen et al.
4,320,162 A 3/1982 Schulz
4,331,510 A 5/1982 Wells
4,382,987 A 5/1983 Smart
4,440,597 A 4/1984 Wells et al.
4,501,862 A 2/1985 Keim
4,507,351 A 3/1985 Johnson et al.
4,514,345 A 4/1985 Johnson et al.
4,515,657 A 5/1985 Maslanka
4,528,239 A 7/1985 Trokhan
4,529,480 A 7/1985 Trokhan
4,537,657 A 8/1985 Keim
4,545,857 A 10/1985 Wells
4,637,859 A 1/1987 Trokhan
4,678,590 A 7/1987 Nakamura et al.
4,714,736 A 12/1987 Juhl et al.
4,770,920 A 9/1988 Larsonneur
4,780,357 A 10/1988 Akao
4,808,467 A 2/1989 Suskind et al.
4,836,894 A 6/1989 Chance et al.
4,849,054 A 7/1989 Klowak
4,885,202 A 12/1989 Lloyd et al.
4,891,249 A 1/1990 McIntyre
4,909,284 A 3/1990 Kositzke
4,949,668 A 8/1990 Heindel et al.
4,949,688 A 8/1990 Bayless
4,983,256 A 1/1991 Combette et al.
4,996,091 A 2/1991 McIntyre
5,059,282 A 10/1991 Ampulski et al.
5,143,776 A 9/1992 Givens
5,149,401 A 9/1992 Langevin et al.
5,152,874 A 10/1992 Keller
5,211,813 A 5/1993 Sawley et al.
5,239,047 A 8/1993 Devore et al.
5,279,098 A 1/1994 Fukuda
5,281,306 A 1/1994 Kakiuchi et al.
5,330,619 A 7/1994 Johnson et al.
5,334,289 A 8/1994 Trokhan et al.
5,347,795 A 9/1994 Fukuda
5,397,435 A 3/1995 Ostendorf et al.
5,399,412 A 3/1995 Sudall et al.
5,405,501 A 4/1995 Phan et al.
5,409,572 A 4/1995 Kershaw et al.
5,429,686 A 7/1995 Chiu et al.
5,439,559 A 8/1995 Crouse
5,447,012 A 9/1995 Kovacs et al.
5,470,436 A 11/1995 Wagle et al.
5,487,313 A 1/1996 Johnson
5,509,913 A 4/1996 Yeo
5,510,002 A 4/1996 Hermans et al.
5,529,665 A 6/1996 Kaun
5,581,906 A 12/1996 Ensign et al.
5,591,147 A 1/1997 Couture-Dorschner et al.
5,607,551 A 3/1997 Farrington, Jr. et al.
5,611,890 A 3/1997 Vinson et al.
5,628,876 A 5/1997 Ayers et al.
5,635,028 A 6/1997 Vinson et al.
5,649,916 A 7/1997 DiPalma et al.
5,671,897 A 9/1997 Ogg et al.
5,672,248 A 9/1997 Wendt et al.
5,679,222 A 10/1997 Rasch et al.
5,685,428 A 11/1997 Herbers et al.
5,728,268 A 3/1998 Weisman et al.
5,746,887 A 5/1998 Wendt et al.
5,753,067 A 5/1998 Fukuda et al.
5,772,845 A 6/1998 Farrington, Jr. et al.
5,806,569 A 9/1998 Gulya et al.
5,827,384 A 10/1998 Canfield et al.
5,832,962 A 11/1998 Kaufman et al.
5,846,380 A 12/1998 Van Phan et al.
5,855,738 A 1/1999 Weisman et al.
5,858,554 A 1/1999 Neal et al.
5,865,396 A 2/1999 Ogg et al.
5,865,950 A 2/1999 Vinson et al.
5,893,965 A 4/1999 Trokhan et al.
5,913,765 A 6/1999 Burgess et al.
5,942,085 A 8/1999 Neal et al.
5,944,954 A 8/1999 Vinson et al.
5,948,210 A 9/1999 Huston
5,980,691 A 11/1999 Weisman et al.
6,036,139 A 3/2000 Ogg
6,039,838 A 3/2000 Kaufman et al.
6,048,938 A 4/2000 Neal et al.
6,060,149 A 5/2000 Nissing et al.
6,106,670 A 8/2000 Weisman et al.
6,149,769 A 11/2000 Mohammadi et al.
6,162,327 A 12/2000 Batra et al.
6,162,329 A 12/2000 Vinson et al.
6,187,138 B1 2/2001 Neal et al.
6,200,419 B1 3/2001 Phan
6,203,667 B1 3/2001 Huhtelin
6,207,734 B1 3/2001 Vinson et al.
6,231,723 B1 5/2001 Kanitz et al.
6,287,426 B1 9/2001 Edwards et al.
6,303,233 B1 10/2001 Amon et al.
6,319,362 B1 11/2001 Huhtelin et al.
6,344,111 B1 2/2002 Wilhelm
6,420,013 B1 7/2002 Vinson et al.
6,420,100 B1 7/2002 Trokhan et al.
6,423,184 B2 7/2002 Vahatalo et al.
6,458,246 B1 10/2002 Kanitz et al.
6,464,831 B1 10/2002 Trokhan et al.
6,473,670 B1 10/2002 Huhtelin
6,521,089 B1 2/2003 Griech et al.
6,537,407 B1 3/2003 Law et al.
6,547,928 B2 4/2003 Barnholtz et al.
6,551,453 B2 4/2003 Weisman et al.
6,551,691 B1 4/2003 Hoeft et al.
6,572,722 B1 6/2003 Pratt
6,579,416 B1 6/2003 Vinson et al.
6,602,454 B2 8/2003 McGuire et al.
6,607,637 B1 8/2003 Vinson et al.
6,610,173 B1 8/2003 Lindsay et al.
6,613,194 B2 9/2003 Kanitz et al.
6,660,362 B1 9/2003 Lindsay et al.
6,673,202 B2 1/2004 Burazin
6,701,637 B2 5/2004 Lindsay et al.
6,743,571 B1 6/2004 Hill et al.
6,755,939 B2 6/2004 Vinson et al.
6,773,647 B2 8/2004 McGuire et al.
6,797,117 B1 9/2004 McKay et al.
6,808,599 B2 10/2004 Burazin
6,821,386 B2 11/2004 Weisman et al.
6,821,391 B2 11/2004 Scherb et al.
6,827,818 B2 12/2004 Farrington, Jr. et al.
6,863,777 B2 3/2005 Kanitz et al.
6,896,767 B2 5/2005 Wilhelm
6,939,443 B2 9/2005 Ryan et al.
6,998,017 B2 2/2006 Lindsay et al.
6,998,024 B2 2/2006 Burazin
7,005,043 B2 2/2006 Toney et al.
7,014,735 B2 3/2006 Kramer et al.
7,105,465 B2 9/2006 Patel et al.
7,155,876 B2 1/2007 VanderTuin et al.

(56) References Cited

U.S. PATENT DOCUMENTS 7,157,389 B2 1/2007 Branham et al.
7,182,837 B2 2/2007 Chen et al.
7,194,788 B2 3/2007 Clark et al.
7,235,156 B2 6/2007 Baggot
7,269,929 B2 9/2007 VanderTuin et al.
7,294,230 B2 11/2007 Flugge-Berendes et al.
7,311,853 B2 12/2007 Vinson et al.
7,328,550 B2 2/2008 Floding et al.
7,339,378 B2 3/2008 Han et al.
7,351,307 B2 4/2008 Scherb et al.
7,387,706 B2 6/2008 Herman et al.
7,399,378 B2 7/2008 Edwards et al.
7,419,569 B2 9/2008 Hermans
7,427,434 B2 9/2008 Busam
7,431,801 B2 10/2008 Conn et al.
7,432,309 B2 10/2008 Vinson
7,442,278 B2 10/2008 Murray et al.
7,452,447 B2 11/2008 Duan et al.
7,476,293 B2 1/2009 Herman et al.
7,494,563 B2 2/2009 Edwards et al.
7,510,631 B2 3/2009 Scherb et al.
7,513,975 B2 4/2009 Burma
7,563,344 B2 7/2009 Beuther
7,582,187 B2 9/2009 Scherb et al.
7,611,607 B2 11/2009 Mullally et al.
7,622,020 B2 11/2009 Awofeso
7,662,462 B2 2/2010 Noda
7,670,678 B2 3/2010 Phan
7,683,126 B2 3/2010 Neal et al.
7,686,923 B2 3/2010 Scherb et al.
7,687,140 B2 3/2010 Manifold et al.
7,691,230 B2 4/2010 Scherb et al.
7,744,722 B1 6/2010 Tucker et al.
7,744,726 B2 6/2010 Scherb et al.
7,799,382 B2 9/2010 Payne et al.
7,811,418 B2 10/2010 Klerelid et al.
7,815,978 B2 10/2010 Davenport et al.
7,823,366 B2 11/2010 Schoeneck
7,842,163 B2 11/2010 Nickel et al.
7,867,361 B2 1/2011 Salaam et al.
7,871,692 B2 1/2011 Morin et al.
7,887,673 B2 2/2011 Andersson et al.
7,905,989 B2 3/2011 Scherb et al.
7,914,866 B2 3/2011 Shannon et al.
7,931,781 B2 4/2011 Scherb et al.
7,951,269 B2 5/2011 Herman et al.
7,955,549 B2 6/2011 Noda
7,959,764 B2 6/2011 Ringer et al.
7,972,475 B2 7/2011 Chan et al.
7,989,058 B2 8/2011 Manifold et al.
8,034,463 B2 10/2011 Leimbach et al.
8,051,629 B2 11/2011 Pazdernik et al.
8,075,739 B2 12/2011 Scherb et al.
8,092,652 B2 1/2012 Scherb et al.
8,118,979 B2 2/2012 Herman et al.
8,147,649 B1 4/2012 Tucker et al.
8,152,959 B2 4/2012 Elony et al.
8,196,314 B2 6/2012 Munch
8,216,427 B2 7/2012 Klerelid et al.
8,236,135 B2 8/2012 Prodoehl et al.
8,303,773 B2 11/2012 Scherb et al.
8,382,956 B2 2/2013 Boechat et al.
8,402,673 B2 3/2013 Da Silva et al.
8,409,404 B2 4/2013 Harper et al.
8,435,384 B2 5/2013 Da Silva et al.
8,440,055 B2 5/2013 Scherb et al.
8,445,032 B2 5/2013 Topolkaraev et al.
8,454,800 B2 6/2013 Mourad et al.
8,470,133 B2 6/2013 Cunnane et al.
8,506,756 B2 8/2013 Denis et al.
8,544,184 B2 10/2013 Da Silva et al.
8,574,211 B2 11/2013 Morita
8,580,083 B2 11/2013 Boechat et al.
8,728,277 B2 5/2014 Boechat et al.
8,758,569 B2 6/2014 Aberg et al.
8,771,466 B2 7/2014 Denis et al.
8,801,903 B2 8/2014 Mourad et al.
8,815,057 B2 8/2014 Eberhardt et al.
8,822,009 B2 9/2014 Riviere et al.
8,968,517 B2 3/2015 Ramaratnam et al.
8,980,062 B2 3/2015 Karlsson et al.
9,005,710 B2 4/2015 Jones et al.
D734,617 S 7/2015 Seitzinger et al.
9,095,477 B2 8/2015 Yamaguchi
D738,633 S 9/2015 Seitzinger et al.
9,382,666 B2 7/2016 Ramaratnam et al.
9,506,203 B2 11/2016 Ramaratnam et al.
9,580,872 B2 2/2017 Ramaratnam et al.
9,702,089 B2 7/2017 Ramaratnam et al.
9,702,090 B2 7/2017 Ramaratnam et al.
9,719,213 B2 8/2017 Miller, IV et al.
9,725,853 B2 8/2017 Ramaratnam et al.
2001/0018068 A1 8/2001 Lorenzi et al.
2002/0028230 A1 3/2002 Eichhorn et al.
2002/0060049 A1 5/2002 Kanitz et al.
2002/0061386 A1 5/2002 Carson et al.
2002/0098317 A1 7/2002 Jaschinski et al.
2002/0110655 A1 8/2002 Seth
2002/0115194 A1 8/2002 Lange et al.
2002/0125606 A1 9/2002 McGuire et al.
2003/0024674 A1 2/2003 Kanitz et al.
2003/0056911 A1 3/2003 Hermans et al.
2003/0056917 A1 3/2003 Jimenez
2003/0070781 A1 4/2003 Hermans et al.
2003/0114071 A1 6/2003 Everhart et al.
2003/0159401 A1 8/2003 Sorenson et al.
2003/0188843 A1 10/2003 Kanitz et al.
2003/0218274 A1 11/2003 Boutilier et al.
2004/0118531 A1 6/2004 Shannon et al.
2004/0123963 A1 7/2004 Chen et al.
2004/0126601 A1 7/2004 Kramer et al.
2004/0126710 A1 7/2004 Hill et al.
2004/0168784 A1 9/2004 Duan et al.
2004/0173333 A1 9/2004 Hermans et al.
2004/0234804 A1 11/2004 Liu et al.
2005/0016704 A1 1/2005 Huhtelin
2005/0069679 A1 3/2005 Stelljes et al.
2005/0069680 A1 3/2005 Stelljes et al.
2005/0098281 A1 5/2005 Schulz et al.
2005/0112115 A1 5/2005 Khan
2005/0123726 A1 6/2005 Broering et al.
2005/0130536 A1 6/2005 Siebers et al.
2005/0136222 A1 6/2005 Hada et al.
2005/0148257 A1 7/2005 Hermans et al.
2005/0150626 A1 7/2005 Kanitz et al.
2005/0166551 A1 8/2005 Keane et al.
2005/0241786 A1 11/2005 Edwards et al.
2005/0241788 A1 11/2005 Baggot et al.
2005/0252626 A1 11/2005 Chen et al.
2005/0280184 A1 12/2005 Sayers et al.
2005/0287340 A1 12/2005 Morelli et al.
2006/0005916 A1 1/2006 Stelljes et al.
2006/0013998 A1 1/2006 Stelljes, et al.
2006/0019567 A1 1/2006 Sayers
2006/0083899 A1 4/2006 Burazin et al.
2006/0093788 A1 5/2006 Behm et al.
2006/0113049 A1 6/2006 Knobloch et al.
2006/0130986 A1 6/2006 Flugge-Berendes et al.
2006/0194022 A1 8/2006 Boutilier et al.
2006/0269706 A1 11/2006 Shannon et al.
2007/0020315 A1 1/2007 Shannon et al.
2007/0131366 A1 6/2007 Underhill et al.
2007/0137813 A1 6/2007 Nickel et al.
2007/0137814 A1 6/2007 Gao
2007/0170610 A1 7/2007 Payne et al.
2007/0240842 A1 10/2007 Scherb et al.
2007/0251659 A1 11/2007 Fernandes et al.
2007/0251660 A1 11/2007 Walkenhaus et al.
2007/0267157 A1 11/2007 Kanitz et al.
2007/0272381 A1 11/2007 Elony et al.
2007/0275866 A1 11/2007 Dykstra
2007/0298221 A1 12/2007 Vinson
2008/0035289 A1 2/2008 Edwards et al.
2008/0076695 A1 3/2008 Uitenbroek et al.

(56) References Cited

U.S. PATENT DOCUMENTS

2008/0156450 A1 7/2008 Klerelid et al.
2008/0199655 A1 8/2008 Monnerie et al.
2008/0245498 A1 10/2008 Ostendorf et al.
2008/0302493 A1 12/2008 Boatman et al.
2008/0308247 A1 12/2008 Ringer et al.
2009/0020248 A1 1/2009 Sumnicht et al.
2009/0056892 A1 3/2009 Rekoske
2009/0061709 A1 3/2009 Nakai et al.
2009/0194244 A1* 8/2009 Harper ..... D21H 15/02 162/111
2009/0205797 A1 8/2009 Fernandes et al.
2009/0218056 A1 9/2009 Manifold et al.
2010/0065234 A1 3/2010 Klerelid et al.
2010/0119779 A1 5/2010 Ostendorf et al.
2010/0224338 A1 9/2010 Harper et al.
2010/0230064 A1 9/2010 Eagles et al.
2010/0236034 A1 9/2010 Eagles et al.
2010/0239825 A1 9/2010 Sheehan et al.
2010/0272965 A1 10/2010 Schinkoreit et al.
2011/0027545 A1 2/2011 Harlacher et al.
2011/0180223 A1 7/2011 Klerelid et al.
2011/0189435 A1 8/2011 Manifold et al.
2011/0189442 A1 8/2011 Manifold et al.
2011/0206913 A1 8/2011 Manifold et al.
2011/0223381 A1 9/2011 Sauter et al.
2011/0253329 A1 10/2011 Manifold et al.
2011/0265967 A1 11/2011 Van Phan
2011/0303379 A1 12/2011 Boechat et al.
2012/0118523 A1 5/2012 Lu et al.
2012/0144611 A1 6/2012 Baker et al.
2012/0152475 A1 6/2012 Edwards et al.
2012/0177888 A1 7/2012 Escafere et al.
2012/0244241 A1 9/2012 McNeil
2012/0267063 A1 10/2012 Klerelid et al.
2012/0297560 A1 11/2012 Zwick et al.
2013/0008135 A1 1/2013 Moore et al.
2013/0029105 A1 1/2013 Miller et al.
2013/0029106 A1 1/2013 Lee et al.
2013/0133851 A1 5/2013 Boechat et al.
2013/0150817 A1 6/2013 Kainth et al.
2013/0160960 A1 6/2013 Hermans et al.
2013/0209749 A1 8/2013 Myangiro et al.
2013/0248129 A1 9/2013 Manifold et al.
2013/0327487 A1 12/2013 Espinosa et al.
2014/0004307 A1 1/2014 Sheehan
2014/0041820 A1 2/2014 Ramaratnam et al.
2014/0041822 A1 2/2014 Boechat et al.
2014/0050890 A1 2/2014 Zwick et al.
2014/0053994 A1 2/2014 Manifold et al.
2014/0096924 A1 4/2014 Rekoske et al.
2014/0174685 A1 6/2014 Gu et al.
2014/0182798 A1 7/2014 Polat et al.
2014/0242320 A1 8/2014 McNeil et al.
2014/0272269 A1 9/2014 Hansen
2014/0272747 A1 9/2014 Ciurkot
2014/0284011 A1 9/2014 Krapsch et al.
2014/0284237 A1 9/2014 Gosset
2014/0360519 A1 12/2014 George et al.
2015/0059995 A1 3/2015 Ramaratnam et al.
2015/0102526 A1 4/2015 Ward et al.
2015/0129146 A1 5/2015 Chou et al.
2015/0211179 A1 7/2015 Alias et al.
2015/0241788 A1 8/2015 Yamaguchi
2015/0330029 A1 11/2015 Ramaratnam et al.
2016/0017542 A1* 1/2016 Bradley ..... D21H 11/04 162/111
2016/0060811 A1 3/2016 Riding et al.
2016/0090692 A1 3/2016 Eagles et al.
2016/0090693 A1 3/2016 Eagles et al.
2016/0130762 A1 5/2016 Ramaratnam et al.
2016/0145810 A1 5/2016 Miller, IV et al.
2016/0159007 A1 6/2016 Miller, IV et al.
2016/0160448 A1 6/2016 Miller, IV et al.
2016/0185041 A1 6/2016 Topolkaraev et al.
2016/0185050 A1 6/2016 Topolkaraev et al.
2016/0273168 A1 9/2016 Ramaratnam et al.
2016/0273169 A1 9/2016 Ramaratnam et al.
2016/0289897 A1 10/2016 Ramaratnam et al.
2016/0289898 A1 10/2016 Ramaratnam et al.
2017/0044717 A1 2/2017 Quigley
2017/0101741 A1 4/2017 Sealey et al.
2017/0167082 A1 6/2017 Ramaratnam et al.
2017/0226698 A1 8/2017 LeBrun et al.
2017/0233946 A1 8/2017 Sealey et al.
2017/0253422 A1 9/2017 Anklam et al.
2017/0268178 A1 9/2017 Ramaratnam et al.

FOREIGN PATENT DOCUMENTS

CN 1138356 A 12/1996
CN 1207149 A 2/1999
CN 1244899 A 2/2000
CN 1268559 A 10/2000
CN 1377405 A 10/2002
CN 2728254 Y 9/2005
DE 4242539 A1 8/1993
EP 0097036 A2 12/1983
EP 0979895 A1 2/2000
EP 1911574 A1 1/2007
EP 1339915 B1 7/2007
EP 2123826 A2 5/2009
GB 946093 A 1/1964
JP 2013208298 A 10/2013
JP 2014213138 A 11/2014
WO 96/06223 A1 2/1996
WO 200382550 A2 10/2003
WO 200445834 A1 6/2004
WO 2007070145 A1 6/2007
WO 2008019702 A1 2/2008
WO 2009006709 A1 1/2009
WO 2009/061079 A1 5/2009
WO 2009067079 A1 5/2009
WO 2011028823 A1 3/2011
WO 2012003360 A2 1/2012
WO 2013/026578 A1 2/2013
WO 2013024297 A1 2/2013
WO 2013/124542 A1 8/2013
WO 2013136471 A1 9/2013
WO 2013/192082 A1 12/2013
WO 2014/022848 A1 2/2014
WO 201500755 A1 1/2015
WO 2015/176063 A1 11/2015
WO 2016/077594 A1 5/2016
WO 2016/086019 A1 6/2016
WO 2016/090242 A1 6/2016
WO 2016/090364 A1 6/2016
WO 2016085704 A1 6/2016
WO 2016/108741 A1 7/2016
WO 2016/122477 A1 8/2016
WO 2017066465 A1 4/2017
WO 2017086656 A1 4/2017
WO 2017139786 A1 8/2017

OTHER PUBLICATIONS

Written Opinion of International Searching Authority for PCT/US16/56871 dated Jan. 12, 2017.
International Search Report for PCT/US2016/057163 dated Dec. 23, 2016.
Written Opinion of International Searching Authority for PCT/US2016/057163 dated Dec. 23, 2016.
International Search Report for PCT/US2017/029890 dated Jul. 14, 2017.
Written Opinion of International Searching Authority for PCT/US2017/029890 dated Jul. 14, 2017.
International Search Report for PCT/US2017/032746 dated Aug. 7, 2017.
Written Opinion of International Searching Authority for PCT/US2017/032746 dated Aug. 7, 2017.
International Search Report for PCT/US17117705 dated Jun. 9, 2017.

(56) References Cited

OTHER PUBLICATIONS

Written Opinion of International Searching Authority for PCT/US17/17705 dated Jun. 9, 2017.
Written Opinion of International Searching Authority for PCT/US15/62483 dated May 6, 2016.
International Search Report for PCT/US15/63986 dated Mar. 29, 2016.
Written Opinion of International Searching Authority for PCT/US15/63986 dated Mar. 29, 2016.
International Search Report for PCT/US15/64284 dated Feb. 11, 2016.
Written Opinion of International Searching Authority for PCT/US15/64284 dated Feb. 11, 2016.
International Search Report for PCT/US13/53593 dated Dec. 30, 2013.
Written Opinion of International Searching Authority for PCT/US13/53593 dated Dec. 30, 2013.
International Search Report for PCT/US15/31411 dated Aug. 13, 2015.
Written Opinion of International Searching Authority for PCT/US15/31411 dated Aug. 13, 2015.
International Search Report for PCT/US15/60398 dated Jan. 29, 2018.
Written Opinion of International Searching Authority for PCT/US15/60398 dated Jan. 29, 2016.
International Search Report for PCT/US15/62483 dated May 6, 2016.
International Preliminary Report on Patentability of PCT/US2013/053593 dated Feb. 3, 2015.
Supplementary European Search Report of EP 13 82 6461 dated Apr. 1, 2016.
European Office Action dated Aug. 20, 2020 in connection with European Patent Application No. 17 844 527.6.

* cited by examiner

| | |
|---|---|
| 1 | Begin by turning both the computer and GATS machine on (the red light will turn on). If the balance is not already on, push the power button and allow a few minutes for the load to stabilize. |
| 2 | Open the computer program "**MK GATS**" and click "**Connect**" when the program has loaded. |
| 3 | Before beginning any tests, check the following:<br>a. Is there water in the upper reservoir?<br>b. Is the plate's meniscus at a good level?<br>c. Is there water in the balance reservoir and is it reading 0 grams?<br>d. Is the hose connecting the reservoir to the stage free of bubbles? |
| 4 | After setup is complete, you are ready to begin testing. Obtain a 100 cm^2 circularly sample and Click the "**Test**" button. |
| 5 | Ensure the balance automatically zeroed and then place the pre-cut sample on the elevated balance platform, making sure it doesn't touch the edges of the balance. Once the load has stabilized, click "**Weigh**". |
| 6 | Move the sample to the wetting stage and center it, with the emboss side facing down. Make sure the sample does not touch the edges of the platform, and carefully cover it with the clear plastic lid. |
| 7 | In the comments section, enter any desired information. Click "**Open File**" and save the test. Click "**Open**". |
| 8 | Click "**Start Logging**" to complete the test. The sample will absorb, elevate, desorb, and return. Occasionally, a sample will not absorb enough water to complete the test. If this is the case, double check the meniscus height and retest a new sample. If the problem persists, your sample may be incompatible with this test method. |
| 9 | Once the test is complete, click "Refill Reservoir" and remove the wet sample. Dry both the stage and the lid with a paper towel before completing a second test. Record any data before clicking "**Test**" again. |
| 10 | At any time during the testing process, you can stop the current test by clicking "**Abort**" |

| | Extended Setup |
|---|---|
| a | If there isn't a sufficient amount of water in the upper reservoir, add DI water (from the machine to the left of the sink in the analytical lab) until full. |
| b | b. IS the platform meniscus at a good level? The meniscus should be right below the surface of the plate. To raise and lower the plate, use the "1 cm up" or "1 cm down" button in the computer program. To make small changes, hold down shift while clicking these buttons to achieve 1 mm movements |
| c | c. Is there water in the balance reservoir and is it reading 0 grams? Add DI water using the bottle or syringe until the balance reads 0 grams. The initial weight will likely be negative from evaporation so this is often necessary before testing. Do not add too much water or the load on the balance will be too heavy. |
| d | d. The force balance between the reservoir and meniscus can be interrupted by air in the hose. To ensure there is no air, turn the stopcock to the "T" position and add water to the open end of the hose using the bulb until all bubbles have been forced out. |

FIG. 5

ABSORBENT STRUCTURES WITH HIGH WET STRENGTH, ABSORBENCY, AND SOFTNESS

RELATED APPLICATIONS

This application is a divisional of and claims priority to and the benefit of U.S. patent application Ser. No. 15/687,116, filed Aug. 25, 2017 and entitled METHOD OF PRODUCING ABSORBENT STRUCTURES WITH HIGH WET STRENGTH, ABSORBENCY, AND SOFTNESS, which in turn claims priority to and the benefit of U.S. Provisional Application No. 62/380,137, filed Aug. 26, 2016 and entitled METHOD OF PRODUCING ABSORBENT STRUCTURES WITH HIGH WET STRENGTH, ABSORBENCY, AND SOFTNESS, the contents of which are incorporated herein by reference in their entirety.

TECHNICAL FIELD

The present invention relates to a method of producing wet laid disposable absorbent structures of high wet strength, absorbency, and softness.

BACKGROUND

Disposable paper towels, napkins, and facial tissue are absorbent structures that need to remain strong when wet. For example, paper towels need to retain their strength when absorbing liquid spills, cleaning windows and mirrors, scrubbing countertops and floors, scrubbing and drying dishes, washing/cleaning bathroom sinks and toilets, and even drying/cleaning hands and faces. A disposable towel that can perform these demanding tasks, while also being soft, has a competitive advantage as the towel could be multi-purpose and be used as a napkin and facial tissue. The same can be said about a napkin or facial tissue, which could become a multi-purpose product if the right combination of quality attributes can be obtained of which wet strength, absorbency, and softness are key attributes.

The industrial methods or technologies used to produce these absorbent structures are numerous. The technologies that use water to form the cellulosic (or other natural or synthetic fiber type) webs that comprise the towel or wipe are called Water-Laid Technologies. These include Through Air Drying (TAD), Uncreped Through Air Drying (UCTAD), Conventional Wet Crepe (CWC), Conventional Dry Crepe (CDC), ATMOS, NTT, QRT and ETAD. Technologies that use air to form the webs that comprise the towel or wipe are called Air-Laid Technologies. To enhance the strength and absorbency of these towels and wipes, more than one layer of web (or ply) can be laminated together using strictly a mechanical process or preferably a mechanical process that utilizes an adhesive.

Absorbent structures can be produced using both Water or Air-Laid technologies. The Water-Laid technologies of Conventional Dry and Wet Crepe are the predominant method to make these structures. These methods comprise forming a nascent web in a forming structure, transferring the web to a dewatering felt where it is pressed to remove moisture, and adhering the web to a Yankee Dryer. The web is then dried and creped from the Yankee Dryer and reeled. When creped at a solids content of less than 90%, the process is referred to as Conventional Wet Crepe. When creped at a solids content of greater than 90%, the process is referred to as Conventional Dry Crepe. These processes can be further understood by reviewing Yankee Dryer and Drying, A TAPPI PRESS Anthology, pg 215-219 which is herein incorporated by reference. These methods are well understood and easy to operate at high speeds and production rates. Energy consumption per ton is low since nearly half of the water removed from the web is through drainage and mechanical pressing. Unfortunately, the sheet pressing also compacts the web which lowers web thickness and resulting absorbency.

Through Air Drying (TAD) and Uncreped Through Air Drying (UCTAD) processes are Wet-Laid technologies that avoid compaction of the web during drying and thereby produce absorbent structures of superior thickness and absorbency when compared to structures of similar basis weight and material inputs that are produced using the CWP or CDC process. Patents which describe creped through air dried products include U.S. Pat. Nos. 3,994,771, 4,102,737, 4,191,609, 4,529,480, 467,859, and 5,510,002, while U.S. Pat. No. 5,607,551 describes an uncreped through air dried product.

The remaining Wet-Laid processes termed ATMOS, ETAD, NTT, STT and QRT can also be utilized to produce absorbent structures. Each process/method utilizes some pressing to dewater the web, or a portion of the web, resulting in absorbent structures with absorbent capacities that correlate to the amount of pressing utilized when all other variables are the same. The ATMOS process and products are documented in U.S. Pat. Nos. 7,744,726, 6,821,391, 7,387,706, 7,351,307, 7,951,269, 8,118,979, 8,440,055, 7,951,269 or 8,118,979, 8,440,055, 8,196,314, 8,402,673, 8,435,384, 8,544,184, 8,382,956, 8,580,083, 7,476,293, 7,510,631, 7,686,923, 7,931,781, 8,075,739, 8,092,652, 7,905,989, 7,582,187, 7,691,230. The ETAD process and products are disclosed in U.S. Pat. Nos. 7,339,378, 7,442,278, and 7,494,563. The NTT process and products are disclosed in international patent application WO 2009/061079 A1 and U.S. Patent Application Publication Nos. US 2011/0180223 A1 and US 2010/0065234 A1. The QRT process is disclosed in U.S. Patent Application Publication No. 2008/0156450 A1 and U.S. Pat. No. 7,811,418. The STT process is disclosed in U.S. Pat. No. 7,887,673.

To impart wet strength to the absorbent structure in the wet laid process, typically a cationic strength component is added to the furnish during stock preparation. The cationic strength component can include any polyethyleneimine, polyethylenimine, polyaminoamide-epihalohydrin (preferably epichlorohydrin), polyamine-epichlorohydrin, polyamide, or polyvinyl amide wet strength resin. Useful cationic thermosetting polyaminoamide-epihalohydrin and polyamine-epichlorohydrin resins are disclosed in U.S. Pat. Nos. 5,239,047, 2,926,154, 3,049,469, 3,058,873, 3,066,066, 3,125,552, 3,186,900, 3,197,427, 3,224,986, 3,224,990, 3,227,615, 3,240,664, 3,813,362, 3,778,339, 3,733,290, 3,227,671, 3,239,491, 3,240,761, 3,248,280, 3,250,664, 3,311,594, 3,329,657, 3,332,834, 3,332,901, 3,352,833, 3,248,280, 3,442,754, 3,459,697, 3,483,077, 3,609,126, 4,714,736, 3,058,873, 2,926,154, 3,877,510, 4,515,657, 4,537,657, 4,501,862, 4,147,586, 4,129,528 and 3,855,158.

Absorbent structures are also made using the Air-Laid process. This process spreads the cellulosic, or other natural or synthetic fibers, in an air stream that is directed onto a moving belt. These fibers collect together to form a web that can be thermally bonded or spray bonded with resin and cured. Compared to Wet-Laid, the web is thicker, softer, more absorbent and also stronger. It is known for having a textile-like surface and drape. Spun-Laid is a variation of the Air-Laid process, which produces the web in one continuous process where plastic fibers (polyester or polypropylene) are spun (melted, extruded, and blown) and then directly spread into a web in one continuous process. This technique has gained popularity as it can generate faster belt speeds and reduce costs.

To further enhance the strength of the absorbent structure, more than one layer of web (or ply) can be laminated together using strictly a mechanical process or preferably a mechanical process that utilizes an adhesive. It is generally understood that a multi-ply structure can have an absorbent capacity greater than the sum of the absorbent capacities of the individual single plies. It is thought this difference is due to the inter-ply storage space created by the addition of an extra ply. When producing multi-ply absorbent structures, it is critical that the plies are bonded together in a manner that will hold up when subjected to the forces encountered when the structure is used by the consumer. Scrubbing tasks such as cleaning countertops, dishes, and windows all impart forces upon the structure which can cause the structure to rupture and tear. When the bonding between plies fails, the plies move against each other imparting frictional forces at the ply interface. This frictional force at the ply interface can induce failure (rupture or tearing) of the structure thus reducing the overall effectiveness of the product to perform scrubbing and cleaning tasks.

There are many methods used to join or laminate multiple plies of an absorbent structure to produce a multiply absorbent structure. One method commonly used is embossing. Embossing is typically performed by one of three processes: tip to tip, nested, and/or rubber to steel embossing. Tip to tip embossing comprises axially parallel jumbo rolls of the absorbent structure juxtaposed to form a nip between the crests of the embossing tips of the opposing emboss rolls. The nip in nested embossing has the embossing tips on one emboss roll meshed between the embossing tips of the other. Rubber to steel embossing comprises a steel roll with embossing tips opposed to a roll having an elastomeric roll cover wherein the two rolls are axially parallel and juxtaposed to form a nip where the embossing tips of the emboss roll mesh with the elastomeric roll cover of the opposing roll.

For example, during the tip to tip embossing process of a two ply absorbent structure web, each web is fed through separate nips formed between separate embossing rolls and pressure rolls with the embossing tips on the embossing rolls producing compressed regions in each web. The two webs are then fed through a common nip formed between the embossing rolls where the embossing tips on the two rolls bring the webs together in a face to face contacting relationship.

By comparison, nested embossing works by having the crests of the embossing tips on one embossing roll intermesh with the embossing tips on the opposing embossing roll with the nip formed between the two rolls. As the web is passed between the two embossing rolls, a pattern is produced on the surface of the web by the interconnectivity of the tips of one roll with the open spaces of the opposing roll.

Rubber to steel embossing works by having one hard embossing roll with embossing tips in a desired pattern and a back-side soft impression roll, often having an elastomeric roll cover aligned in an axially parallel configuration to form a nip between the rolls. As the web is passed through the nip between the rolls, the embossing tips impress the web against and into the rubber to deform the structure of the web.

It is possible to marry two or more webs of an absorbent structure (or different absorbent structures) together using an adhesive. In an exemplary nested embossing process an adhesive applicator roll may be aligned in an axially parallel arrangement with one of the two embossing rolls forming a nip therewith, such that the adhesive applicator roll is upstream of the nip formed between the two embossing rolls. The adhesive applicator roll transfers adhesive to the embossed webs on the embossing roll at the crests of the embossing knobs. The crests of the embossing knobs typically do not touch the perimeter of the opposing roll at the nip formed there between, necessitating the addition of a marrying roll to apply pressure for lamination. The marrying roll forms a nip with the same embossing roll forming the nip with the adhesive applicator roll, downstream of the nip formed between the two embossing rolls. An example of this lamination method is described in U.S. Pat. No. 5,858,554.

Other attempts to laminate absorbent structure webs include bonding the plies at junction lines wherein the lines include individual pressure spot bonds. The spot bonds are formed by the use of thermoplastic low viscosity liquid such as melted wax, paraffin, or hot melt adhesive, as described in U.S. Pat. No. 4,770,920. Another method laminates webs of absorbent structure by thermally bonding the webs together using polypropylene melt blown fibers, as described in U.S. Pat. No. 4,885,202. Other methods use meltblown adhesive applied to one face of an absorbent structure web in a spiral pattern, a stripe pattern, or random patterns before pressing the web against the face of a second absorbent structure, as described in U.S. Pat. Nos. 3,911,173, 4,098,632, 4,949,688, 4,891249, 4,996,091 and 5,143,776.

SUMMARY OF THE INVENTION

This invention relates to a method of producing single or multi-ply, cellulosic based, wet laid, disposable, absorbent structures of high wet strength, absorbency, and softness by utilizing cationic wet strength resin(s) with anionic polyacrylamide(s) and cellulase enzyme(s) in the stock preparation stage of the manufacturing process of any wet laid manufacturing process.

The cationic wet strength resin can be one or a combination of the following: polyethyleneimine, polyethylenimine, polyaminoamide-epihalohydrin (preferably epichlorohydrin) polyamine-epichlorohydrin, polyamide, or polyvinyl amide wet strength resin.

The anionic polyacrylamide(s) can be of various molecular weights and charge density.

The cellulase enzyme(s) can be mono-component or multi-component endo-cellulases, exo-cellulases, or cellobiase cellulases.

This invention allows for the removal of carboxymethylcellulose, CMC, and limits mechanical refining, both of which can adversely affect softness by imparting stiffness and high surface roughness to the absorbent structure.

The absorbent structures of preferred application of the invention's method are disposable paper towel, napkin, and facial products.

An absorbent structure according to an exemplary embodiment of the present invention has a CD wet tensile strength value that is at least 35% of the value of a CD dry tensile strength value of the absorbent structure.

In at least one embodiment, the absorbent structure comprises two or more plies.

In at least one embodiment, each ply comprises a multilayer web.

In at least one embodiment, the absorbent structure is a paper towel product.

In at least one embodiment, the absorbent structure has a HF softness of at least 46.

In at least one embodiment, the absorbent structure has a TS750 value of less than 60.

These and other features and advantages of the present invention will be presented in more detail in the following detailed description and the accompanying figures which illustrate by way of example principles of the invention.

DESCRIPTION OF THE DRAWINGS

The features and advantages of exemplary embodiments of the present invention will be more fully understood with reference to the following, detailed description when taken in conjunction with the accompanying figures, wherein:

FIG. 5 is a list of steps performed during absorbency testing of absorbent products.

DETAILED DESCRIPTION

Figure 1:
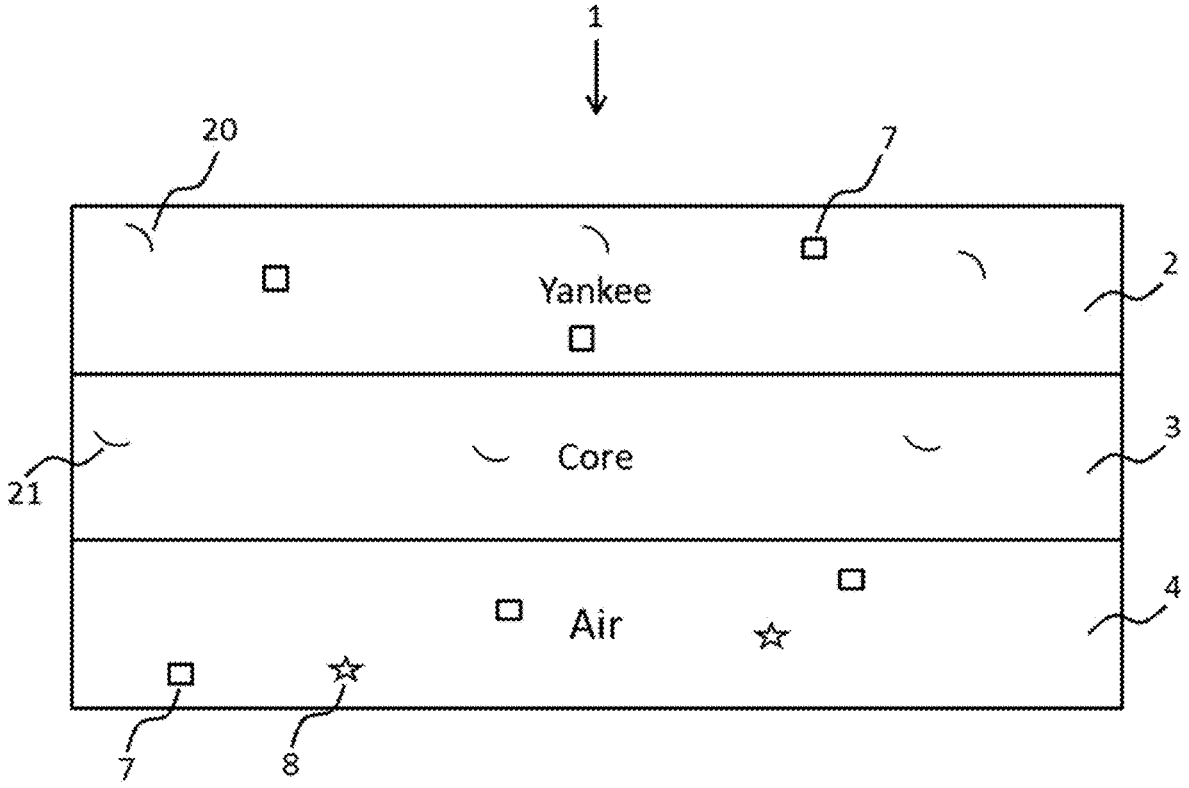
FIG. 1 is a schematic diagram of a three layer tissue in accordance with an exemplary embodiment of the present invention.

As discussed, to impart wet strength to the absorbent structure in a wet laid process, a cationic strength component may be added to the furnish during stock preparation. To impart capacity of the cationic strength resins it is well known in the art to add water soluble carboxyl containing polymers to the furnish in conjunction with the cationic resin. Suitable carboxyl containing polymers include carboxymethylcellulose (CMC) as disclosed in U.S. Pat. Nos. 3,058,873, 3,049,469 and 3,998,690. However, the use of CMC can be disadvantageous because it prohibits the use of cellulase enzymes, which would otherwise react with the CMC to cleave bonds and shorten the degree of polymerization of the molecule, rendering it much less effective. Anionic polyacrylamide polymers are an alternative to using carboxyl containing polymers to improve wet strength development in conjunction with cationic strength resins, as disclosed in U.S. Pat. Nos. 3,049,469 and 6,939,443.

When replacing CMC with an anionic polyacrylamide to boost the efficacy of the cationic wet strength resin, the use of cellulase enzymes becomes possible. Cellulase is generally referred to as an enzyme composition derived from a microorganism, fungi, or bacterial that can catalyze the hydrolysis of B-1-4 glycosidic bonds of a cellulose molecule or its derivatives. There are three types of cellulases, each having a different activation towards the cellulose molecule. The three types are endo-cellulases, exo-cellulases, and cellobiase cellulases. Cellulases can be used to modify the surface of the cellulose molecules, which are contained in the fibers used to make absorbent structures, and disrupt the crystalline structure of the cellulose to fibrillate the fiber, thereby enhancing the fiber to fiber bonding during web formation and the final strength of the absorbent structure. The ability to provide enhanced fibrillation and fiber to fiber bonding can limit or eliminate the need for mechanical refining to fibrillate the fiber, which can reduce bulk, absorbency, and softness of the absorbent structure.

According to an exemplary embodiment of the present invention, one or more cationic strength resins, one or more anionic polyacrylamides (APAM) and one or more cellulase enzymes are added to the pulp slurry (furnish) during the stock preparation stage of an absorbent product manufacturing process. Without being bound by theory, the APAM promotes the wet strength imparting capacity of the cationic strength resins, and the cellulase provides enhanced fibrillation and fiber to fiber bonding so that mechanical refining can be minimized or eliminated.

The following description relates to a multi-layer tissue product, and is provided to illustrate one possible application of the present invention. However, it should be appreciated that inventive aspects of the present invention involving the combined use of APAM and cellulase may be applicable to any wet-laid manufacturing process for an absorbent paper product.

FIG. 1 shows a three layer tissue, generally designated by reference number 1, according to an exemplary embodiment of the present invention. The general structure and manufacturing process of the tissue 1 are as described in U.S. Pat. No. 8,968,517 (assigned to applicant), the contents of which are incorporated herein by reference in their entirety. The tissue 1 has external layers 2 and 4 as well as an internal, core layer 3. External layer 2 is composed primarily of hardwood fibers 20 whereas external layer 4 and core layer 3 are composed of a combination of hardwood fibers 20 and softwood fibers 21. The internal core layer 3 includes an ionic surfactant functioning as a debonder 5 and a non-ionic surfactant functioning as a softener 6. As explained in further detail below, external layers 2 and 4 also include non-ionic surfactant that migrated from the internal core layer 3 during formation of the tissue 1. External layer 2 further includes a dry strength additive 7. External layer 4 further includes both a dry strength additive 7 and a temporary wet strength additive 8.

Pulp mixes for exterior layers of the tissue are prepared with a blend of primarily hardwood fibers. For example, the pulp mix for at least one exterior layer is a blend containing about 70 percent or greater hardwood fibers relative to the total percentage of fibers that make up the blend. As a further example, the pulp mix for at least one exterior layer is a blend containing about 80 percent hardwood fibers relative to the total percentage of fibers that make up the blend.

Pulp mixes for the interior layer of the tissue are prepared with a blend of primarily softwood fibers. For example, the pulp mix for the interior layer is a blend containing about 70 percent or greater softwood fibers relative to the total percentage of fibers that make up the blend. As a further example, the pulp mix for the interior layer is a blend containing about 90-100 percent softwood fibers relative to the total percentage of fibers that make up the blend.

As known in the art, pulp mixes are subjected to a dilution stage in which water is added to the mixes so as to form a slurry. After the dilution stage but prior to reaching the headbox, each of the pulp mixes are dewatered to obtain a thick stock of about 95% water. In an exemplary embodiment of the invention, wet end additives are introduced into the thick stock pulp mixes of at least the interior layer. In an exemplary embodiment, a non-ionic surfactant and an ionic surfactant are added to the pulp mix for the interior layer. Suitable non-ionic surfactants have a hydrophilic-lipophilic balance of less than 10, and preferably less than or equal to 8.5. An exemplary non-ionic surfactant is an ethoxylated vegetable oil or a combination of two or more ethoxylated vegetable oils. Other exemplary non-ionic surfactants include ethylene oxide, propylene oxide adducts of fatty alcohols, alkyl glycoside esters, and alkylethoxylated esters.

Suitable ionic surfactants include but are not limited to quaternary amines and cationic phospholipids. An exemplary ionic surfactant is 1,2-di(heptadecyl)-3-methyl-4,5-dihydroimidazol-3-ium methyl sulfate. Other exemplary ionic surfactants include (2-hydroxyethyl)methylbis[2-[(1-oxooctadecyl)oxy] ethyl] ammonium methyl sulfate, fatty dialkyl amine quaternary salts, mono fatty alkyl tertiary amine salts, unsaturated fatty alkyl amine salts, linear alkyl sulfonates, alkyl-benzene sulfonates and trimethyl-3-[(1-oxooctadecyl)amino]propylammonium methyl sulfate.

In an exemplary embodiment, the ionic surfactant may function as a debonder while the non-ionic surfactant functions as a softener. Typically, the debonder operates by breaking bonds between fibers to provide flexibility, however an unwanted side effect is that the overall strength of the tissue can be reduced by excessive exposure to debonder. Typical debonders are quaternary amine compounds such as trimethyl cocoammonium chloride, trymethyloleylammonium chloride, dimethyldi(hydrogenated-tallow)ammonium chloride and trimethylstearylammonium chloride.

After being added to the interior layer, the non-ionic surfactant (functioning as a softener) migrates through the other layers of the tissue while the ionic surfactant (functioning as a debonder) stays relatively fixed within the interior layer. Since the debonder remains substantially within the interior layer of the tissue, softer hardwood fibers (that may have lacked sufficient tensile strength if treated with a debonder) can be used for the exterior layers. Further, because only the interior of the tissue is treated, less debonder is required as compared to when the whole tissue is treated with debonder.

In an exemplary embodiment, the ratio of ionic surfactant to non-ionic surfactant added to the pulp mix for the interior layer of the tissue is between 1:4 and 1:90 parts by weight and preferably about 1:8 parts by weight. In particular, when the ionic surfactant is a quaternary amine debonder, reducing the concentration relative to the amount of non-ionic surfactant can lead to an improved tissue. Excess debonder, particularly when introduced as a wet end additive, can weaken the tissue, while an insufficient amount of debonder may not provide the tissue with sufficient flexibility. Because of the migration of the non-ionic surfactant to the exterior layers of the tissue, the ratio of ionic surfactant to non-ionic surfactant in the core layer may be significantly lower in the actual tissue compared to the pulp mix.

In an exemplary embodiment, a dry strength additive is added to the thick stock mix for at least one of the exterior layers. The dry strength additive may be, for example, amphoteric starch, added in a range of about 1 to 40 kg/ton. In another exemplary embodiment, a wet strength additive is added to the thick stock mix for at least one of the exterior layers. The wet strength additive may be, for example, glyoxalated polyacrylamide, commonly known as GPAM, added in a range of about 0.25 to 5 kg/ton. In a further exemplary embodiment, both a dry strength additive, preferably amphoteric starch, and a wet strength additive, preferably GPAM, are added to one of the exterior layers. Without being bound by theory, it is believed that the combination of both amphoteric starch and GPAM in a single layer when added as wet end additives provides a synergistic effect with regard to strength of the finished tissue to reduce linting. Other exemplary temporary wet-strength agents include aldehyde functionalized cationic starch, aldehyde functionalized polyacrylamides, acrolein co-polymers and cis-hydroxyl polysaccharide (guar gum and locust bean gum) used in combination with any of the above mentioned compounds.

In an exemplary embodiment, APAM is added to the thick stock mix for at least one of the exterior layers along with the wet strength additive. The use of APAM allows for the addition of cellulase to the thick stock mix so that mechanical refining can be limited or eliminated.

In addition to amphoteric starch, suitable dry strength additives may include but are not limited to polyvinyl amine, glyoxalated polyacrylamide, cationic starch, carboxy methyl cellulose, guar gum, locust bean gum, cationic polyacrylamide, polyvinyl alcohol, anionic polyacrylamide or a combination thereof.

Figure 2:
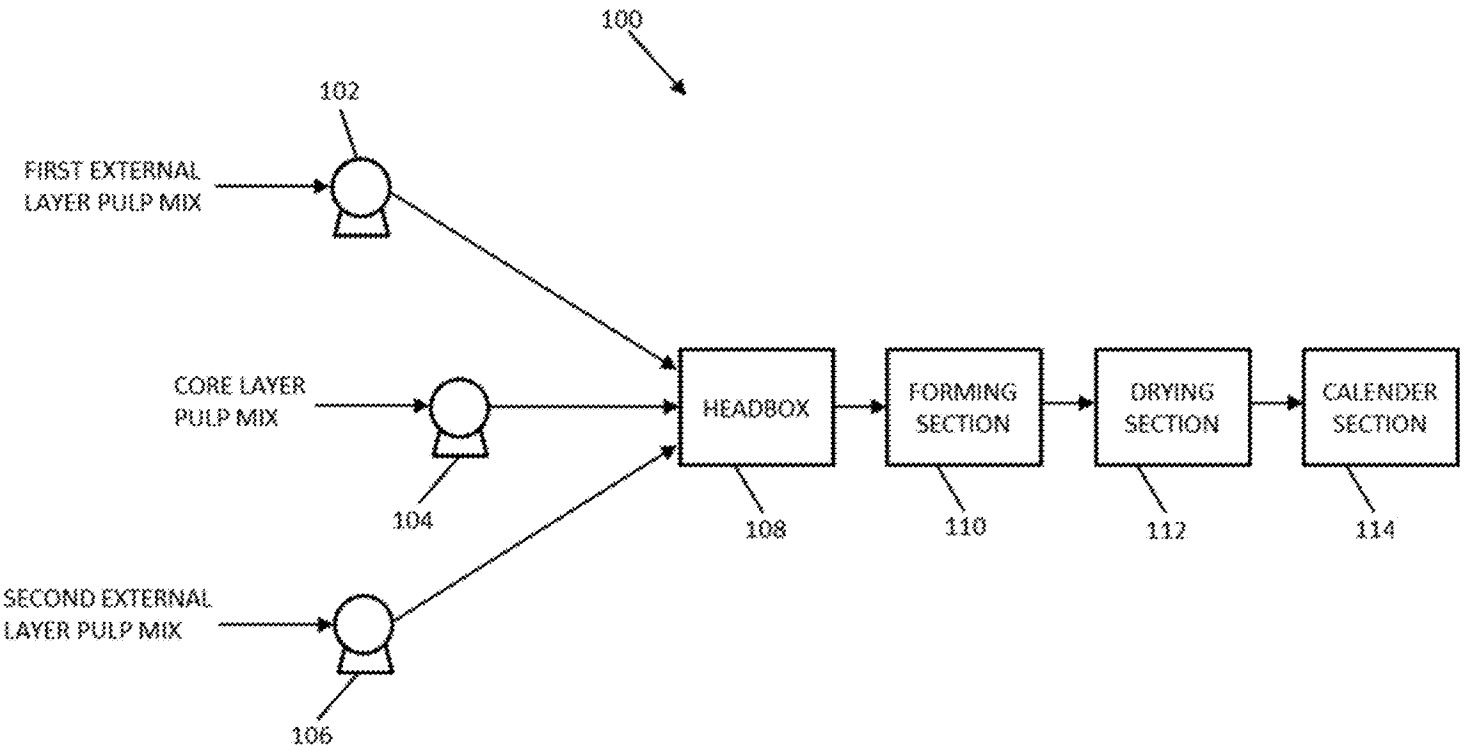
FIG. 2 is a block diagram of a system for manufacturing tissue according to an exemplary embodiment of the present invention.

FIG. 2 is a block diagram of a system for manufacturing tissue, generally designated by reference number 100, according to an exemplary embodiment of the present invention. The system 100 includes an first exterior layer fan pump 102, a core layer fan pump 104, a second exterior layer fan pump 106, a headbox 108, a forming section 110, a drying section 112 and a calendar section 114. The first and second exterior layer fan pumps 102, 106 deliver the pulp mixes of the first and second external layers 2, 4 to the headbox 108, and the core layer fan pump 104 delivers the pulp mix of the core layer 3 to the headbox 108. As is known in the art, the headbox delivers a wet web of pulp onto a forming wire within the forming section 110. The wet web is laid on the forming wire with the core layer 3 disposed between the first and second external layers 2, 4.

After formation in the forming section 110, the partially dewatered web is transferred to the drying section 112, Within the drying the section 112, the tissue of the present invention may be dried using conventional through air drying processes. In an exemplary embodiment, the tissue of the present invention is dried to a humidity of about 7 to 20% using a through air drier manufactured by Metso Corporation, of Helsinki, Finland. In another exemplary embodiment of the invention, two or more through air drying stages are used in series. Without being bound by theory, it is believed that the use of multiple drying stages improves uniformity in the tissue, thus reducing tears.

In an exemplary embodiment, the tissue of the present invention is patterned during the through air drying process. Such patterning can be achieved through the use of a TAD fabric, such as a G-weave (Prolux 003) or M-weave (Prolux 005) TAD fabric.

After the through air drying stage, the tissue of the present invention may be further dried in a second phase using a Yankee drying drum. In an exemplary embodiment, a creping adhesive is applied to the drum prior to the tissue contacting the drum. A creping blade is then used to remove the tissue from the Yankee drying drum. The tissue may then be calendered in a subsequent stage within the calendar section 114. According to an exemplary embodiment, calendaring may be accomplished using a number of calendar rolls (not shown) that deliver a calendering pressure in the range of 0-100 pounds per linear inch (PLI). In general, increased calendering pressure is associated with reduced caliper and a smoother tissue surface.

According to an exemplary embodiment of the invention, a ceramic coated creping blade is used to remove the tissue from the Yankee drying drum. Ceramic coated creping blades result in reduced adhesive build up and aid in achieving higher run speeds. Without being bound by theory, it is believed that the ceramic coating of the creping blades provides a less adhesive surface than metal creping blades and is more resistant to edge wear that can lead to localized spots of adhesive accumulation. The ceramic creping blades allow for a greater amount of creping adhesive to be used which in turn provides improved sheet integrity and faster run speeds.

In addition to the use of wet end additives, the tissue of the present invention may also be treated with topical or surface deposited additives. Examples of surface deposited additives include softeners for increasing fiber softness and skin lotions. Examples of topical softeners include but are not limited to quaternary ammonium compounds, including, but not limited to, the dialkyldimethylammonium salts (e.g. ditallowdimethylammonium chloride, ditallowdimethylammonium methyl sulfate, di(hydrogenated tallow)dimethyl ammonium chloride, etc.). Another class of chemical softening agents include the well-known organo-reactive polydimethyl siloxane ingredients, including amino functional polydimethyl siloxane. zinc stearate, aluminum stearate, sodium stearate, calcium stearate, magnesium stearate, spermaceti, and steryl oil.

After the tissue basesheet is produced a laminate, composed of two webs/plies are laminated together in a face-to face relationship using an aqueous adhesive. The adhesives used to laminate the plies of absorbent structure can be water soluble of the group consisting of polyvinyl alcohol, polyvinyl acetate, starch based or mixtures thereof. The mixture is comprised of 1% to 10% by weight of the adhesives. Additionally; the mixture can contain up 10% by weight of a water soluble cationic resin selected from the group consisting of polyamide-epichlorohydrin resins, glyoxalated polyacrylamide resins, polyethyleneimine resins, polyethylenimine resins, or mixtures thereof. The remainder of the mixture is composed of water. This mixture is heated and maintained to a temperature between 90 deg F. to 150 deg F., preferably to 120 F.

The adhesive is heated and maintained at temperature utilizing an insulated stainless steel tank with heating elements uniformly distributed throughout the interior heating surface. The large amount of surface area heated provides uniform heating controlled by an adjustable thermostat. The tank is designed with an agitator that to ensure proper mixing and heat transfer.

The adhesive is applied using an applicator roll, aligned in an axially parallel arrangement with one of the two embossing rolls forming a nip therewith, such that the adhesive applicator roll is upstream of the nip formed between the two embossing rolls. The adhesive applicator roll transfers adhesive to the embossed webs on the embossing roll at the crests of the embossing knobs. The crests of the embossing knobs typically do not touch the perimeter of the opposing roll at the nip formed there between necessitating the addition of a marrying roll to apply pressure for lamination. The marrying roll forms a nip with the same embossing roll forming the nip with the adhesive applicator roll, downstream of the nip formed between the two embossing rolls.

Figure 3:
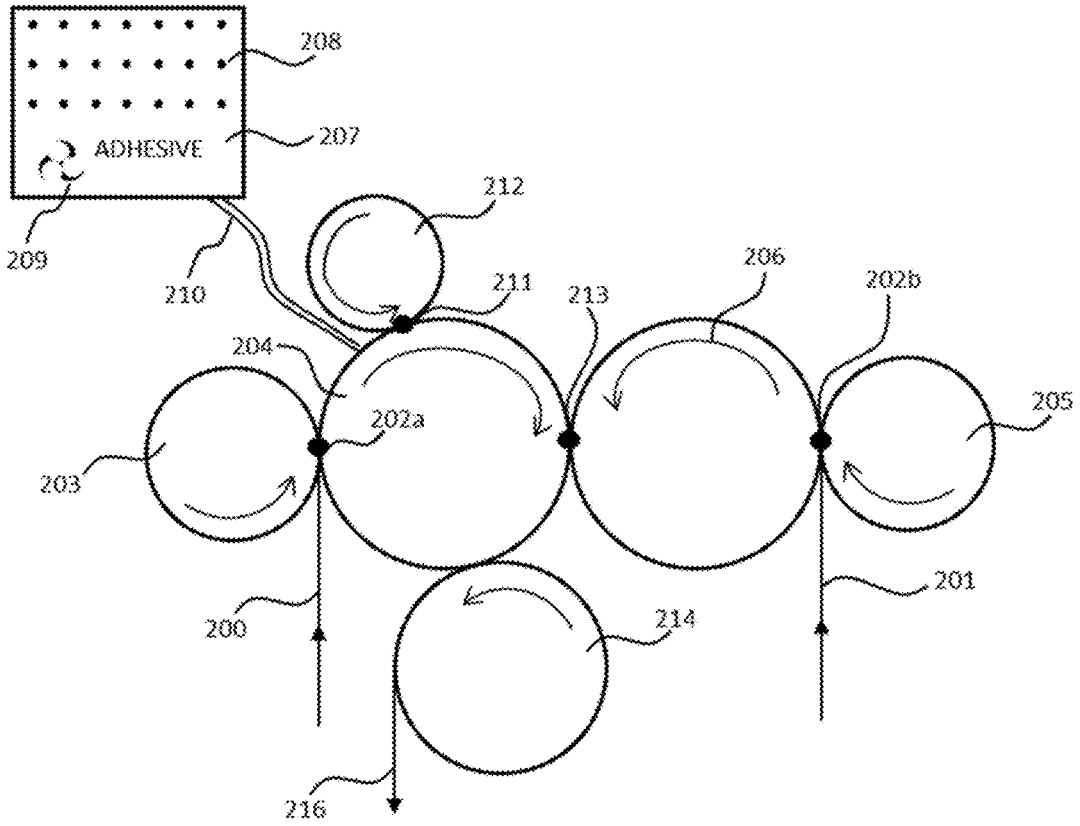
FIG. 3 is a block diagram of a system for manufacturing a multi-ply absorbent product according to an exemplary embodiment of the present invention.

FIG. 3 shows an apparatus for manufacturing a laminate of two plies of an absorbent product that are joined to each other, in a face-to-face relationship, in accordance with an exemplary embodiment of the present invention to form an absorbent product, such as a paper towel. As shown in the figure, two webs 200, 201 of single ply tissue, which may be manufactured, for example, according to a method described above, are fed to respective pairs of mated pressure rolls 203, 205 and substantially axially parallel embossing rolls 204, 206. A first web 200 is thus fed through a nip 202*a* formed by pressure roll 203 and embossing roll 204 (also known as a pattern roll) and a second web 201 is likewise fed through a nip 202*b* between pressure roll 205 and embossing roll 206. The embossing rolls 204, 206, which rotate in the illustrated directions, impress an embossment pattern onto the webs as they pass through nip 202*a* and 202*b*. After being embossed, each ply may have a plurality of embossments protruding outwardly from the plane of the ply towards the adjacent ply. The adjacent ply likewise may have opposing protuberances protruding towards the first ply. If a three ply product is produced by adding a third pair of mated pressure and embossing rolls, the central ply may have embossments extending outwardly in both directions.

To perform the embossments at nips 202*a* and 202*b*, the embossing rolls 204, 206 have embossing tips or embossing knobs that extend radially outward from the rolls to make the embossments. In the illustrated embodiment, embossing is performed by nested embossing in which the crests of the embossing knobs on one embossing roll intermesh with the embossing knobs on the opposing embossing roll and a nip is formed between the embossing rolls. As the web is fed through nips 202*a* and 202*b*, a pattern is produced on the surface of the web by the interconnectivity of the knobs on an embossing roll with the open spaces of the respective pressure roll.

An adhesive applicator roll 212 is positioned upstream of the nip 213 formed between the two embossing rolls and is aligned in an axially parallel arrangement with one of the two embossing rolls to form a nip therewith. The heated adhesive is fed from an adhesive tank 207 via a conduit 210 to applicator roll 212. The applicator roll 212 transfers heated adhesive to an interior side of embossed ply 200 to adhere the at least two plies 200, 201 together, wherein the interior side is the side of ply 200 that comes into a face-to-face relationship with ply 201 for lamination. The adhesive is applied to the ply at the crests of the embossing knobs 205 on embossing roll 204.

Notably, in the present invention, the adhesive is heated and maintained at a desired temperature utilizing, in embodiments, an adhesive tank 207, which is an insulated stainless steel tank that may have heating elements 208 that are substantially uniformly distributed throughout the interior heating surface. In this manner, a large amount of surface area may be heated relatively uniformly. Generally, an adjustable thermostat may be used to control the temperature of the adhesive tank 207. It has been found advantageous to maintain the temperature of the adhesive at between approximately 32 degrees C. (90 degrees F.) to 66 degrees C. (150 degrees F.), and preferably to around 49 degrees C. (120 degrees F.). In addition, in embodiments, the tank has an agitator 209 to ensure proper mixing and heat transfer.

The webs are then fed through the nip 213 where the embossing patterns on each embossing roll 204, 206 mesh with one another.

In nested embossing, the crests of the embossing knobs typically do not touch the perimeter of the opposing roll at the nip formed therebetween. Therefore, after the application of the embossments and the adhesive, a marrying roll 214 is used to apply pressure for lamination. The marrying roll 214 forms a nip with the same embossing roll 204 that forms the nip with the adhesive applicator roll 212, downstream of the nip formed between the two embossing rolls 204, 206. The marrying roll 214 is generally needed because the crests of the nested embossing knobs 205 typically do not touch the perimeter of the opposing roll 206 at the nip 213 formed therebetween.

The specific pattern that is embossed on the absorbent products is significant for achieving the enhanced scrubbing resistance of the present invention. In particular, it has been found that the embossed area on any ply should cover between approximately 5 to 15% of the surface area. Moreover, the size of each embossment should be between approximately 0.04 to 0.08 square centimeters. The depth of the embossment should be within the range of between approximately 0.28 and 0.43 centimeters (0.110 and 0.170 inches) in depth.

Figure 4:
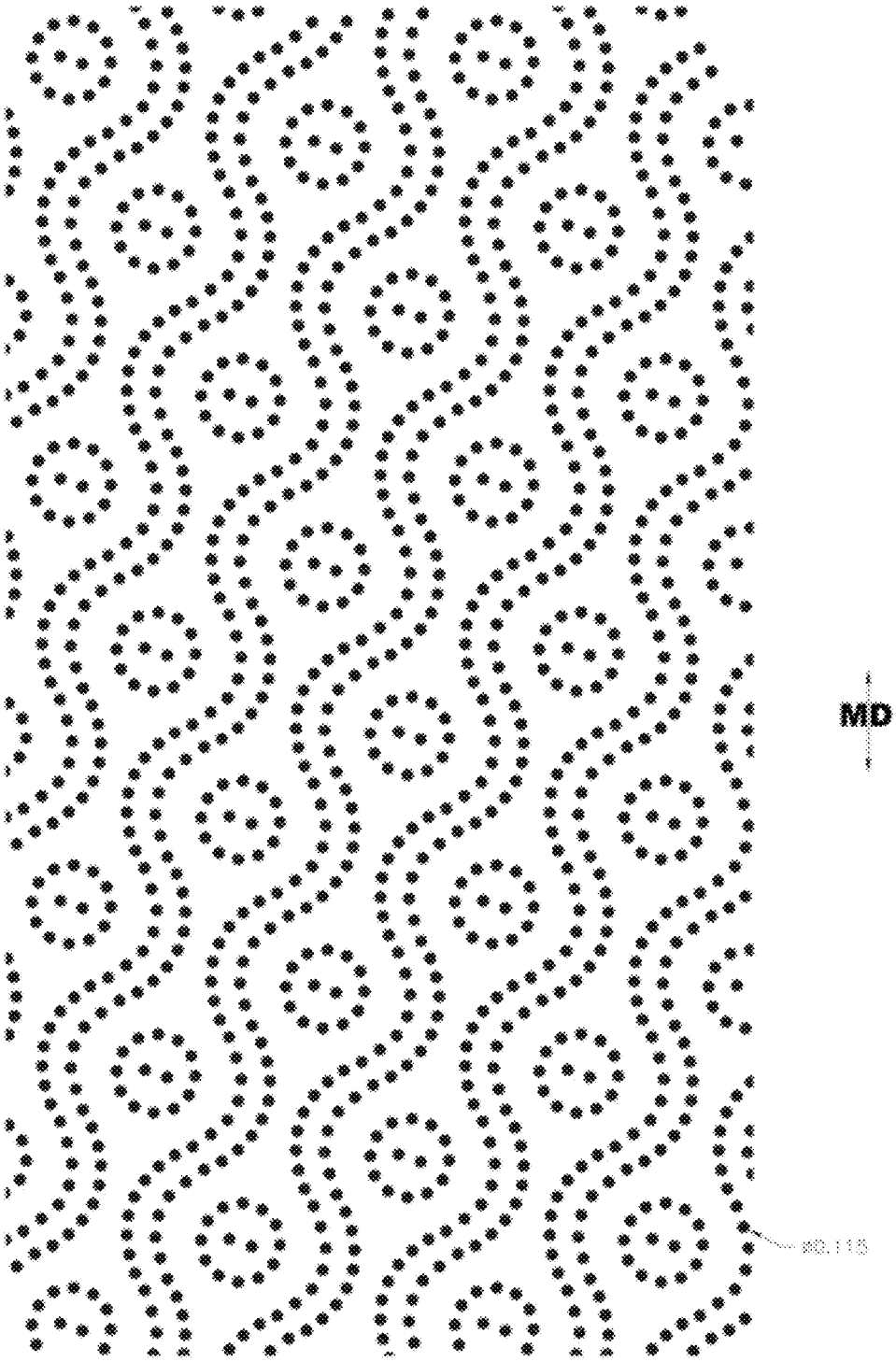
FIG. 4 shows an absorbent product that has an embossed pattern in accordance with an exemplary embodiment of the present invention.

FIG. 4 shows a sample pattern embossed on the absorbent product according to an embodiment of the present invention. In the illustrated pattern, the embossed area covers approximately 13% of the surface, the embossment depth is approximately 0.34 centimeters (0.135 inches) deep, and the embossment diameter is approximately 0.92 centimeters (0.115 inches) across.

The following testing procedures were followed in determining the various attributes of the Examples and Comparative Examples discussed herein.

Ball Burst Testing

Ball Burst of a 2-ply tissue web was determined using a Tissue Softness Analyzer (TSA), available from EMTECH Electronic GmbH of Leipzig, Germany using A ball burst head and holder. A punch was used to cut out five 100 $cm^2$ round samples from the web. One of the samples was loaded into the TSA, with the embossed surface facing down, over the holder and held into place using the ring. The ball burst algorithm was selected from the list of available softness testing algorithms displayed by the TSA. The ball burst head was then pushed by the EMTECH through the sample until the web ruptured and calculated the grams force required for the rupture to occur. The test process was repeated for the remaining samples and the results for all the samples were averaged.

Stretch & MD, CD, and Wet CD Tensile Strength Testing

An Instron 3343 tensile tester, manufactured by Instron of Norwood, Mass., with a 100N load cell and 25.4 mm rubber coated jaw faces was used for tensile strength measurement. Prior to measurement, the Instron 3343 tensile tester was calibrated. After calibration, 8 strips of 2-ply product, each one inch by four inches, were provided as samples for each test. When testing MD, the strips are cut in the MD direction and in the CD direction when testing CD. One of the sample strips was placed in between the upper jaw faces and clamp, and then between the lower jaw faces and clamp with a gap of 2 inches between the clamps. A test was run on the sample strip to obtain tensile and stretch. The test procedure was repeated until all the samples were tested. The values obtained for the eight sample strips were averaged to determine the tensile strength of the tissue. When testing CD wet tensile, the strips are placed in an oven at 105 deg Celsius for 5 minutes and saturated with 75 microliters of deionized water immediately prior to pulling the sample.

Basis Weight

Using a dye and press, six 76.2 mm by 76.2 mm square samples were cut from a 2-ply product being careful to avoid any web perforations. The samples were placed in an oven at 105 deg C. for 5 minutes before being weighed on an analytical balance to the fourth decimal point. The weight of the sample in grams is divided by $(0.0762\ m)^2$ to determine the basis weight in grams/$m^2$.

A Thwing-Albert ProGage 100 Thickness Tester, manufactured by Thwing Albert of West Berlin, using a 2" diameter pressure foot with a preset loading of 0.93 grams/square inch NJ was used for the caliper test. Eight 100 mm×100 mm square samples were cut from a 2-ply product. The samples were then tested individually and the results were averaged to obtain a caliper result for the base sheet.

Softness Testing

Softness of a 2-ply tissue web was determined using a Tissue Softness Analyzer (TSA), available from EMTEC Electronic GmbH of Leipzig, Germany. The TSA comprises a rotor with vertical blades which rotate on the test piece applying a defined contact pressure. Contact between the vertical blades and the test piece creates vibrations which are sensed by a vibration sensor. The sensor then transmits a signal to a PC for processing and display. The frequency analysis in the range of approximately 200 to 1000 Hz represents the surface smoothness or texture of the test piece and is referred to as the TS750 value. A further peak in the frequency range between 6 and 7 kHz represents the bulk softness of the test piece and is referred to as the TS7 value. Both TS7 and TS750 values are expressed as dB $V^2$ rms. The stiffness of the sample is also calculated as the device measures deformation of the sample under a defined load. The stiffness value (D) is expressed as mm/N. The device also calculates a Hand Feel (HF) number with the higher the number corresponding to a higher softness as perceived when someone touches a tissue sample by hand. The HF number is a combination of the TS750, TS7, and stiffness of the sample measured by the TSA and calculated using an algorithm which also requires the caliper and basis weight of the sample. Different algorithms can be selected for different facial, toilet, and towel paper products. Before testing, a calibration check should be performed using "TSA Leaflet Collection No. 9" available from EMTECH dated 2016, May 10. If the calibration check demonstrates a calibration is necessary, follow "TSA Leaflet Collection No. 10" for the calibration procedure available from EMTECH dated 2015, Sep. 9.

A punch was used to cut out five 100 $cm^2$ round samples from the web. One of the samples was loaded into the TSA, clamped into place (outward facing or embossed ply facing upward), and the TPII algorithm was selected from the list of available softness testing algorithms displayed by the TSA. After inputting parameters for the sample (including caliper and basis weight), the TSA measurement program was run. The test process was repeated for the remaining samples and the results for all the samples were averaged and the average HF number recorded.

Absorbency

Absorbency of a 2-ply product was tested using an M/K GATS Liquid Absorption Tester (available from MK Systems, Inc., Peabody, Mass., USA), following the procedure shown in FIG. 4.

The following examples illustrate the advantages provided by exemplary embodiments of the present invention.

COMPARATIVE EXAMPLE 1

Paper towel was produced on a wet-laid asset with a three layer headbox using the through air dried method. The three layers of the single ply of towel were labeled as air, core and Yankee. The air layer was the outer layer that was placed on the structuring fabric, the dryer layer was the outer layer that was closest to the surface of the Yankee dryer, and the core was the center section of the towel.

The towel was produced using 50% eucalyptus and 50% northern bleached softwood kraft (NBSK) fibers prepared individually. The NBSK was refined at 90 kwh/ton with 12 kg/ton polyamine polyamide-epichlorohydrin resin, named Kymene 821 from Solenis (500 Hercules Road, Wilmington Del., 19808), added at the discharge of the refiner. The NBSK and eucalyptus fibers were then mixed together with 4.0 kg/ton of CMC. The pulp was then split fed evenly to three layers with a dry strength additive, Redibond 2038 (Corn Products, 10 Finderne Avenue, Bridgewater, N.J. 08807), added to the core layer and 1.5 kg/ton Hercobond 6950, a polyvinyl amine retention aid from Solenis, added to all three layers. The fiber and chemical mixtures were diluted to a solids of 0.5% consistency at the suction of three fan pumps which delivered the slurry to a triple layered headbox.

The headbox deposited the slurry to a nip formed by a forming roll, an outer forming wire, and inner forming wire where the wires were running at a speed of 1272 m/min. The slurry was drained through the outer wire, which was a KT194-P design supplied by Asten Johnson (4399 Corporate Rd, Charleston, S.C. (843) 747-7800)), to aid with drainage, fiber support, and web formation. When the fabrics separated, the web followed the inner forming wire and was dried to approximately 27% solids using a series of vacuum boxes and a steam box at 30 kpa pressure and 145 deg C.

The web was then transferred to a structuring fabric running at 1200 m/min with the aid of a vacuum box to facilitate fiber penetration into the structuring fabric to enhance bulk softness and web imprinting. The structuring fabric was the Prolux 646 supplied by Albany (216 Airport Drive Rochester, N.H. 03867 USA Tel: +1.603.330.5850). The fabric was a 10 shed design with 12.0 yarn/cm Mesh and Count, a 0.35 mm warp monofilament, a 0.50 mm weft monofilament, a 1.29 mm caliper, with a 670 cfm and a knuckle surface that was sanded to impart 12% contact area with the Yankee dryer. The web was then dried with the aid of two TAD hot air impingement drums to 80% moisture before transfer to the Yankee dryer. The web was held in intimate contact with the Yankee surface using an adhesive coating chemistry. The Yankee was provided steam at 300 kpa while the installed hot air impingement hood over the Yankee was blowing heated air at 125 deg C. The web was creped from the Yankee at 1% crepe at 98.2% dryness using a steel blade at a pocket angle of 90 degrees.

The towel was then plied together using the method described above with reference to FIG. 3, using a steel emboss roll with the pattern shown in FIG. 4 and 7% polyvinyl alcohol based adhesive heated to 120 deg F. The rolled 2-ply product had 150 sheets, a roll diameter of 148 mm, with sheets a length of 6.0 inches and width of 11 inches. The 2-ply tissue product further had the following product attributes: Basis Weight 42.7 g/m$^2$, Caliper 0.891 mm, MD tensile of 512 N/m, CD tensile of 492 N/m, a ball burst of 1329 grams force, an MD stretch of 10.7%, a CD stretch of 11.0%, a CD wet tensile of 145.4 N/m, an absorbency of 697 gsm, a HF softness of 45.1, a TS7 of 24.56, a TS750 of 63.84 and a D value of 2.04 mm/N. The CD wet tensile was 30% the value of the CD dry tensile.

COMPARATIVE EXAMPLE 2

Paper towel was produced on a wet-laid asset with a three layer headbox using the through air dried method. The three layers of the single ply of towel were labeled as air, core and Yankee. The air layer was the outer layer that was placed on the structuring fabric, the dryer layer was the outer layer that was closest to the surface of the Yankee dryer, and the core was the center section of the towel.

The towel was produced using 50% eucalyptus and 50% northern bleached softwood kraft (NBSK) fibers prepared individually. The NBSK was refined at 100 kwh/ton with 12 kg/ton polyamine polyamide-epichlorohydrin resin, named Kymene 821 from Solenis (500 Hercules Road, Wilmington Del., 19808), added at the discharge of the refiner. The NBSK and eucalyptus fibers were then mixed together with 6.0 kg/ton of Hercobond 2800, an anionic polyacrylamide from Solenis. The pulp was then split fed evenly to three layers with 2.0 kg/ton of glyoxylated polyacrylamide, named Fennorez 1000 from Kemira, (1000 Parkwood Circle, Suite 500 Ga. 30339 Atlanta Tel. +1 770 436 1542), added to the Yankee and air layer and 0.5 kg/ton of Hercobond 6950 polyvinyl amine from Solenis added to the core layer. The fiber and chemical mixtures were diluted to a solids of 0.5% consistency at the suction of three fan pumps which delivered the slurry to a triple layered headbox.

The headbox deposited the slurry to a nip formed by a forming roll, an outer forming wire, and inner forming wire where the wires were running at a speed of 1272 m/min. The slurry was drained through the outer wire, which was a KT194-P design supplied by Asten Johnson (4399 Corporate Rd, Charleston, S.C. (843) 747-7800)), to aid with drainage, fiber support, and web formation. When the fabrics separated, the web followed the inner forming wire and was dried to approximately 27% solids using a series of vacuum boxes and a steam box at 30 kpa pressure and 145 deg C.

The web was then transferred to a structuring fabric running at 1200 m/min with the aid of a vacuum box to facilitate fiber penetration into the structuring fabric to enhance bulk softness and web imprinting. The structuring fabric was the Prolux 646 supplied by Albany (216 Airport Drive Rochester, N.H. 03867 USA Tel: +1.603.330.5850). The fabric was a 10 shed design with 12.0 yarn/cm Mesh and Count, a 0.35 mm warp monofilament, a 0.50 mm weft monofilament, a 1.29 mm caliper, with a 670 cfm and a knuckle surface that was sanded to impart 12% contact area with the Yankee dryer. The web was then dried with the aid of two TAD hot air impingement drums to 80% moisture before transfer to the Yankee dryer. The web was held in intimate contact with the Yankee surface using an adhesive coating chemistry. The Yankee was provided steam at 300 kpa while the installed hot air impingement hood over the Yankee was blowing heated air at 125 deg C. The web was creped from the Yankee at 1% crepe at 98.2% dryness using a steel blade at a pocket angle of 90 degrees.

The towel was then plied together using the method described above with reference to FIG. 3, using a steel emboss roll with the pattern shown in FIG. 4 and 7% polyvinyl alcohol based adhesive heated to 120 deg F. The rolled 2-ply product had 150 sheets, a roll diameter of 148 mm, with sheets a length of 6.0 inches and width of 11 inches. The 2-ply tissue product had the following product attributes: Basis Weight 41.76 g/m$^2$, Caliper 0.889 mm, MD tensile of 441 N/m, CD tensile of 390 N/m, a ball burst of 1131 grams force, an MD stretch of 10.9%, a CD stretch of 11.0%, a CD wet tensile of 96.35 N/m, an absorbency of 714 gsm, and a HF softness of 44.7, a TS7 of 22.52, a TS750 of 76.77, and a D value of 2.21 mm/N. The CD wet tensile was 25% of the value of the CD dry tensile.

EXAMPLE 1

Paper towel was produced in the same way as described in Comparative Example 2 with the exception of mixing of 350 ppm of Hercobond 8922, a multicomponent (more than one) exocellulase enzyme from Solenis, with the NBSK in a virgin pulper for 1 hr before refining.

The rolled 2-ply product had 150 sheets, a roll diameter of 148 mm, with sheets a length of 6.0 inches and width of 11 inches. The 2-ply tissue product had the following product attributes: Basis Weight 41.54 g/m$^2$, Caliper 0.881 mm, MD tensile of 515 N/m, CD tensile of 395 N/m, a ball burst of 1223 grams force, an MD stretch of 10.7%, a CD stretch of 10.7%, a CD wet tensile of 150.6 N/m, an absorbency of 700 gsm, a HF softness of 47.1, a TS7 of 22.93, a TS750 of 59.51, and a D value of 2.17 mm/N. The CD wet tensile was 38% of the value of the CD dry tensile.

Example 1, which included the addition of a cellulase enzyme, provided significant improvement in quality attributes as compared to Comparative Example 2. Specifically, the addition of 350 ppm of the cellulase to the NBSK furnish increased Geometric Mean Tensile (square root of the product of MD tensile and CD tensile) by 8.8%, Ball Burst Strength by 8.1%, and wet CD tensile by 56% as compared to Comparative Example 2. The CD wet tensile improved from 25% to 38% of the value of the CD dry tensile. The softness also improved, which was unexpected as softness is typically inversely proportional to tensile strength. Without being bound by theory, it is believed the cellulase enzymes disrupted the crystalline structure of the fiber's cellulose molecules, increasing fiber fibrillation, and exposing more surface area for fiber to fiber bonding and chemical to fiber bonding to occur. This resulted in the improvement in strength properties. The improvement in softness was driven by a reduction in the TS750 parameter measured by the Tissue Softness Analyzer showing an improvement in the surface smoothness of the product. Literature has indicated that cellulase enzyme products degrade fines (by catalyzing the hydrolysis of B-1-4 glycosidic bonds) that collect on the surface of the fibers providing a cleaner fiber surface. Without being bound by theory, it is possible that this cleaner fiber surface improves the smoothness of the product and reduces the TS750 parameter measured by the Tissue Softness Analyzer.

Now that embodiments of the present invention have been shown and described in detail, various modifications and improvements thereon will become readily apparent to those skilled in the art. Accordingly, the spirit and scope of the present invention is to be construed broadly and not limited by the foregoing specification.

The invention claimed is:

1. An absorbent structure having a CD wet tensile strength value that is at least 35% of the value of a CD dry tensile strength value of the absorbent structure, a basis weight of less than 45 gsm, and a TS750 value of less than 60 dB $V^2$ rms, wherein the absorbent structure is a paper towel roll product.

2. The absorbent structure of claim 1, comprising two or more plies.

3. The absorbent structure of claim 2, wherein each ply comprises a multi-layer web.

4. The absorbent structure of claim 1, wherein the absorbent structure has a HF softness of at least 46.

5. The absorbent structure of claim 1, wherein the absorbent structure is made by a Through Air Drying (TAD) process.

* * * * *